US009435093B2

(12) United States Patent
Etyemezian et al.

(10) Patent No.: US 9,435,093 B2
(45) Date of Patent: Sep. 6, 2016

(54) ENGINEERED ROUGHNESS ELEMENTS, ARRAYS THEREOF, AND THEIR METHOD OF USE

(71) Applicant: Board of Regents of the Nevada System of Higher Education, on behalf of the Desert Research Institute, Reno, NV (US)

(72) Inventors: Vicken Etyemezian, Las Vegas, NV (US); John Gillies, Reno, NV (US)

(73) Assignee: Board of Regents of the Nevada System of Higher Education, on behalf of the Desert Research Institute, Reno, NV (US)

( * ) Notice: Subject to any disclaimer, the term of this patent is extended or adjusted under 35 U.S.C. 154(b) by 0 days.

(21) Appl. No.: 14/529,894

(22) Filed: Oct. 31, 2014

(65) Prior Publication Data

US 2015/0117964 A1 Apr. 30, 2015

Related U.S. Application Data

(60) Provisional application No. 61/898,399, filed on Oct. 31, 2013.

(51) Int. Cl.
*E01F 7/02* (2006.01)
*E02D 3/00* (2006.01)

(52) U.S. Cl.
CPC .. *E02D 3/00* (2013.01); *E01F 7/02* (2013.01)

(58) Field of Classification Search
CPC ..... E01F 7/02; E01F 7/025; E02B 3/122; E02B 3/18
USPC ..... 256/12.5; 405/21, 23, 25, 26, 27, 28, 405/34, 35
See application file for complete search history.

(56) References Cited

U.S. PATENT DOCUMENTS 3,214,916 A * 11/1965 Martin ..... E02B 3/04 405/28
3,222,871 A * 12/1965 Miller ..... E02B 3/02 405/27
3,479,824 A * 11/1969 Schaaf ..... E02B 3/06 256/12.5
3,846,990 A * 11/1974 Bowley ..... E02B 3/062 405/26
3,913,889 A * 10/1975 Nugent ..... E04H 17/066 256/12.5
3,966,172 A * 6/1976 Garrett ..... E01F 7/02 256/12.5
3,971,221 A * 7/1976 Greenleaf ..... E02B 3/062 405/26
4,089,179 A * 5/1978 Trautman ..... E02B 3/04 256/12.5
4,529,173 A * 7/1985 Kramer ..... E01F 7/025 104/279

(Continued)

FOREIGN PATENT DOCUMENTS

FR 2393110 A2 * 12/1978 ..... E02B 3/04

OTHER PUBLICATIONS

Brown et al., "A Wind Tunnel Examination of Shear Stress Partitioning for an Assortment of Surface Roughness Distributions", *Journal of Geophysical Research—Earth Surface*, vol. 113, 13 pages (2008).

(Continued)

*Primary Examiner* — Frederick L Lagman
(74) *Attorney, Agent, or Firm* — Klarquist Sparkman, LLP

(57) ABSTRACT

In one embodiment, the present disclosure provides an engineered roughness element. In another embodiment, the present disclosure provides an array of engineered roughness elements. The engineered roughness elements are configured to reduce sand movement and accompanying dust generation.

20 Claims, 8 Drawing Sheets

(56) References Cited

U.S. PATENT DOCUMENTS

| | | | | | |
|---|---|---|---|---|---|
| 4,549,724 | A * | 10/1985 | Taillandier | E01F 7/02 | 104/279 |
| 4,671,495 | A * | 6/1987 | Garland | E01F 7/02 | 104/279 |
| 4,954,013 | A * | 9/1990 | Lamberton | E02B 3/06 | 405/25 |
| 5,029,819 | A * | 7/1991 | Kane | E04H 17/04 | 160/24 |
| 5,039,250 | A * | 8/1991 | Janz | E01F 7/02 | 256/12.5 |
| 5,609,326 | A * | 3/1997 | Stearns | E04D 13/10 | 182/45 |
| 5,795,099 | A * | 8/1998 | Parker | E02B 3/04 | 256/12.5 |
| 5,810,334 | A * | 9/1998 | Menaker | E04H 15/003 | 135/900 |
| 5,888,020 | A * | 3/1999 | Brais | E02B 3/06 | 256/12.5 |
| 6,210,072 | B1 * | 4/2001 | Marelius | E02B 3/04 | 405/100 |
| 6,367,781 | B1 * | 4/2002 | Flynn | E01F 13/022 | 256/45 |
| 6,558,075 | B2 * | 5/2003 | Benedict | E02B 3/06 | 256/12.5 |
| 6,722,817 | B2 * | 4/2004 | Benedict | E02B 3/04 | 405/15 |
| 6,976,807 | B2 * | 12/2005 | King | E02B 3/06 | 405/26 |
| 7,036,798 | B1 * | 5/2006 | Olson | E01F 7/025 | 239/289 |
| 7,857,291 | B2 * | 12/2010 | Dombroski | E04H 17/16 | 256/12.5 |
| 2003/0044233 | A1 * | 3/2003 | Hillard | E02B 3/04 | 405/21 |
| 2003/0095833 | A1 * | 5/2003 | Janz | E02B 3/04 | 403/410 |
| 2007/0125994 | A1 * | 6/2007 | Henning | E01F 7/025 | 256/12.5 |
| 2010/0123112 | A1 * | 5/2010 | Kahtani | E01F 7/02 | 256/12.5 |
| 2011/0220857 | A1 * | 9/2011 | Castro Fresno | E01F 7/02 | 256/12.5 |

OTHER PUBLICATIONS

Cornelis et al., "Optimal Windbreak Design for Wind-Erosion Control", *Journal of Arid Environments* 61(2), 315-332 (2005).

Dong et al., "A Wind Tunnel Simulation of the Mean Velocity Fields Behind Upright Porous Fences", *Agricultural and Forest Meteorology*, 146(1-2), 82-93 (2007).

Giannoulis et al., "Design and Analysis of the Response of Elastically Supported Wind-Break Panels of Two Different Permeabilities Under Wind Load", *Biosystems Engineering* 129, 57-69 (2015).

Giannoulis et al., "Experimental and Numerical Investigation of the Airflow Around a Raised Permeable Panel", *Journal of Wind Engineering Industrial Aerodynamics*, 98(12), 808-817 (2010).

Gillies et al., "Aeolian Sediment Transport through Large Patches of Roughness in the Atmospheric Inertial Sublayer", *Journal of Geophysical Research—Earth Surface*, vol. 111, 13 pages (2006).

Gillies et al., "Effectiveness of Large-Scale Roughness Elements to Control Sand and Dust Flux at the Keeler Dunes, Keeler, CA", Poster presented: *8th International Conference on Aeolian Research*, Lanzhou, China, Jul. 21-25, 2014 (2014).

Gillies et al., "Large Roughness Element Effects on Sand Transport, Oceano Dunes, California", *Earth Surface Processes and Landforms*, 38 (8): 785-792 (2012).

Gillies et al., "Shear Stress Partitioning in Large Patches of Roughness in the Atmospheric Inertial Sublayer", *Boundary-Layer Meteorology*, 122(2): 367-396 (2007).

Gillies et al., "Shelter Index and a Simple Wind Speed Parameter to Characterize Vegetation Control of Sand Transport Threshold and Flux", Invited paper presented: *American Geophysical Union Fall Meeting*, San Francisco, CA, Dec. 15-19, 2014, 27 pages.

Gillies et al., "Using Large-Scale Roughness Elements to Control Sand and Dust Flux at the Keeler Dunes, Keeler, CA", Poster presented: *European Geophysical Union General Assembly*, Vienna, Austria, Apr. 28-May 2, 2014 (2014).

Gillies et al., "Using Roughness (Solid Elements and Plants) to Control Sand Movement and Dust Emissions: Keeler Dunes Dust Demonstration Project", Report prepared for *Great Basin Unified Air Pollution Control District*, Bishop CA, Jul. 2014, 31 pages.

Gillies et al., "Using Solid Element Roughness to Control Sand Movement: Keeler Dunes, Keeler California", *Aeolian Research* 18, 35-46 (2015).

Judd et al., "A Wind Tunnel Study of Turbulent Flow Around Single and Multiple Windbreaks, Part I: Velocity Fields", *Boundary-Layer Meteorology* 80(1-2): 127-165, (1996).

Kim et al., "Hole Diameter Effect on Flow Characteristics of Wake Behind Porous Fences Having the Same Porosity", *Fluid Dynamics Research* 28, 449-464 (2001).

Lancaster et al., "Oceano Dunes Pilot Projects", Report Prepared for *California State Parks and San Luis Obispo County Air Pollution Control District*, Jul. 2011, 55 pages.

Tsukahara et al., "Visualization and Laser Measurements on the Flow Field and Sand Movement on Sand Dunes with Porous Fences", *Experiments in Fluids*, 52(4): 877-890 (2012).

* cited by examiner

ENGINEERED ROUGHNESS ELEMENTS, ARRAYS THEREOF, AND THEIR METHOD OF USE

CROSS REFERENCE TO RELATED APPLICATION

The present application claims the benefit of, and incorporates by reference, U.S. Provisional Patent Application Ser. No. 61/898,399, filed Oct. 31, 2013.

FIELD

The present disclosure relates generally to reduction of fluid borne particulates. In a specific example, the present disclosure provides engineered roughness elements that can be deployed in arrays in order to reduce sand movement and/or airborne particles, such as dust.

BACKGROUND

On a regional basis emissions of windblown dust can degrade air quality below accepted limits and under extreme storm conditions can result in loss of human and animal life as well as severe environmental degradation. The delivery of dust-sized particles (<70 μm) to the atmosphere is an aerodynamically-driven process. There is complex interplay, however, between the resisting and driving forces that control the release and entrainment of these particles and the vertical flux of dust. Entrainment of dust into the wind occurs principally when sand-sized particles transported by the wind (saltation) impact the surface and eject dust sized particles. Dust can also be released to the airflow as aggregates of sediment break down during the vigorous transport process.

SUMMARY

In various embodiments, the present disclosure provides engineered roughness elements and arrays formed therefrom. In one implementation, the engineered roughness elements are active. In another implementation, the engineered roughness elements are passive. In various examples, the engineered roughness elements and arrays thereof can be used to reduce airborne particulates, such as by reducing sand movement and corresponding generation of airborne dust.

In a particular embodiment, the present disclosure provides an engineered roughness element, and an array of such elements, having a porous section. In a particular implementation, the elements include a porous section and a nonporous section. In one example, the porous section is located substantially at a height where airborne particles passing by the engineered roughness element have a maximum kinetic energy.

The engineered roughness elements may have a variety of shapes, including conventional shapes having cross sections of squares, rectangles, triangles, circles, arcs, and similar geometric shapes. In further examples, the roughness elements have more complex shapes, including combinations of shapes having geometric geometries such as squares, rectangles, triangles, circles, and arcs. In a particular example, the engineered roughness element has a shape with a cross section corresponding to a rectangle coupled to a circle.

In further embodiments, the engineered roughness elements include structural features to facilitate placement, movement, or removal of the elements. In a specific example, the elements include openings or other design elements that are configured to receive the blades of a forklift or similar device.

In another embodiment, the engineered roughness elements are configured to be stackable. For example, they may be stackable for storage. In another example, the height of array elements may be configured by stacking a plurality of engineered roughness elements on top of one another.

In a further embodiment, the engineered roughness elements are configured to move when contacted by wind having a sufficient velocity. In one implementation, the engineered roughness element includes a particle control element, such as a planar particle control element, coupled to a pivot by an arm. In a particular example, the particle control element rotates in a plane parallel to the ground, about an axis perpendicular to the ground, to maintain a face of the particle control element perpendicular to the wind direction.

In another implementation, the engineered roughness element includes an upper particle control element coupled to a base by an arm. The engineered roughness element tilts when the upper particle control element is contacted by wind exceeding a threshold velocity. In particular example, the base is configured, such as by being curved, to facilitate such tilting.

In a further implementation, the engineered roughness element includes a particle control element pivotably coupled to a support. In this implementation, the particle control element is rotatable about an axis parallel to the ground.

According to another implementation, the engineered roughness element includes an upper particle control element coupled to a base by an arm. The base is further connected to one or more supports by one or more legs. In use, the engineered roughness element may be placed over a pit or similar storage area formed in a surface, such as the ground. The pit is normally covered by the base. However, when the engineered roughness element is contacted by wind exceeding a threshold velocity, the engineered roughness element moves such that the base allows particles to enter the pit. When the wind goes below the threshold, the base again covers the pit.

A variation of the above implementation includes a motor coupled to a connector, the connector being further coupled to the engineered roughness element. In addition to, or in place of, wind-activated movement, the motor can be activated to retract the connector, causing the engineered roughness element to tilt and the base to allow particles to access. When the connector is released, the pit is once again covered by the base.

In another embodiment of the present disclosure, engineered roughness elements reposition themselves in the presence of water. In one implementation, the engineered roughness element includes a particle control element coupled to an anchor by a tether. In specific examples, the particle control element is buoyant. One particular particle control element includes a solid structure, such as a block (which can be made of concrete, for example), have an internal void that includes a bladder. The bladder may be filled with a fluid, such as air, to increase or decrease the buoyancy of the particle control element.

In yet another embodiment, the engineered roughness elements are designed to reposition themselves when accumulated particles reach a certain level around the elements. For example, the elements may be rounded, including being asymmetrically rounded, so that particle build up on one side of the element will cause the element to roll to a new position.

Arrays of engineered roughness elements, in another embodiment, include individual array elements positioned to channel particle flow to a particular location, such as a storage area. In a particular implementation, the storage area is a channel. In some examples, the storage area is periodically cleaned, such as through mechanical removal or by flushing the area with water.

In another embodiment, an array of engineered roughness elements has a windward side, a middle portion, and a leeward side. In one implementation, the density and/or arrangement of engineered roughness elements is consistent throughout the array. In other implementations, the density and/or arrangement of engineered roughness elements differs between one or more portions of the array. In a particular example, the density of engineered roughness elements is greater at the windward side of the array than in the middle portion of the array.

In another embodiment, an array of engineered roughness elements includes engineered roughness elements sufficiently spaced apart to allow vehicular traffic, such as automobiles or trucks, to pass through the array.

Certain additional aspects of the present disclosure are described in the appended claims. There are additional features and advantages of the various embodiments of the present disclosure. They will become evident from the following disclosure.

In this regard, it is to be understood that this summary and the claims form a brief summary of the various embodiments described herein. Any given embodiment of the present disclosure need not provide all features noted above, nor must it solve all problems or address all issues in the prior art noted above or elsewhere in this disclosure.

BRIEF DESCRIPTION OF THE DRAWINGS

Various embodiments are shown and described in connection with the following drawings in which.

DETAILED DESCRIPTION

Figure 1:
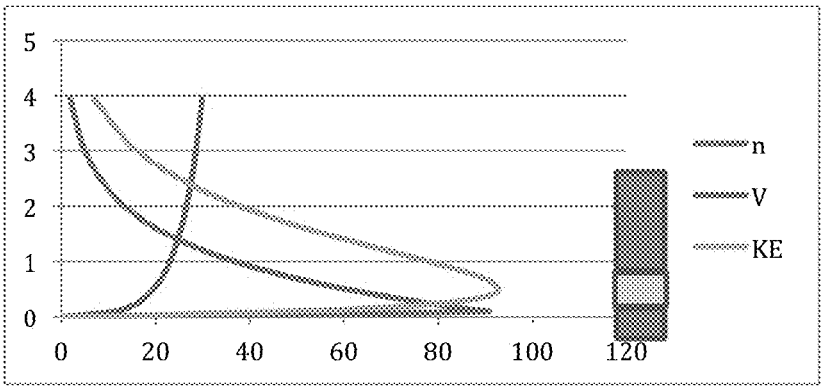
FIG. 1 is a graph of height versus kinetic energy, illustrating the relationship of particle velocity, particle kinetic energy, and particle number as the height above the surface (y axis) increases.

Unless otherwise explained, all technical and scientific terms used herein have the same meaning as commonly understood by one of ordinary skill in the art to which this disclosure belongs. In case of conflict, the present specification, including explanations of terms, will control. The singular terms "a," "an," and "the" include plural referents unless context clearly indicates otherwise. Similarly, the word "or" is intended to include "and" unless the context clearly indicates otherwise. The term "comprising" means "including;" hence, "comprising A or B" means including A or B, as well as A and B together. Although methods and materials similar or equivalent to those described herein can be used in the practice or testing of the present disclosure, suitable methods and materials are described herein. The disclosed materials, methods, and examples are illustrative only and not intended to be limiting.

The apparatus, systems, and methods of the present disclosure are generally applicable to fluid borne, such as airborne, particles, under a variety of natural or artificial environments. Portions of the disclosure may specifically refer to particles as "dust" or "sand." However, it is to be understood that, unless the circumstances clearly suggest otherwise, the discussion is intended to apply to particles, generally, which are capable of being suspended in and moved by the fluid. So, unless indicated or suggested otherwise, "particles" may refer to both dust and sand. Similarly, the disclosure may refer to wind, particularly wind associated with a natural environment. However, the discussion may be extended to artificial winds and even other fluids which exhibit similar relevant physical properties.

In some circumstances, windblown dust is generated when the shearing force of the wind exceeds the resistive forces inherent in the surface and is enhanced by the ballistic impact of saltating particles. The ability of wind shear or a saltating sand particle to cause the emission of dust depends on the proportion of energy available to break inter-particle bonds relative to the resistance of those bonds to rupturing.

The binding energies scale with particle size, moisture content, and the strength of the crust that can form in the sediment.

The forces resisting particle entrainment include physical properties of the surface. Chief among these is the scale of the surface roughness. Roughness effects can be aerodynamic and physical. Aerodynamic effects arise from the flow properties that are influenced by the amount and size of the roughness. Although a secondary effect, roughness also provides direct coverage of the surface, which shelters particles susceptible to entrainment and transport from the wind.

The shear stress generated by the wind flowing over a rough surface is partitioned between the elements that protrude into the boundary-layer and the open ground between them.

A shear stress partitioning model can be defined as:

$$R_t = \frac{u_{*tS}}{u_{*tR}} = \frac{1}{(1 - m\sigma\lambda)^{0.5}(1 + m\beta\lambda)^{0.5}} \quad (1)$$

where $R_t$ is threshold shear velocity ratio, $u_{*t}$ is threshold shear velocity of the bare surface (m $s^{-1}$), $u_{*s}$ is the threshold wind shear velocity with roughness elements present (m $s^{-1}$), $\sigma$ is the roughness element basal area to frontal area ratio, $\lambda$ is roughness density, $\beta$ is the ratio of element to surface drag coefficients, and m is an empirical constant ranging from 0 to 1 that accounts for the spatial heterogeneity of surface shear stress. The roughness density ($\lambda$) is defined as:

$$\lambda = nbh/S \quad (2)$$

where n is the number of roughness elements occupying the ground area S ($m^2$), b is element breadth (m), and h is element height (m).

Shear stress partitioning effects on dust emissions act principally through the modulation of the near surface shear stress. However, large roughness elements in sufficient densities reduce transport rates beyond that attributable to just aerodynamic controls. The ratio of element height to saltation layer height is a parameter that can significantly affect transport rate, with larger ratios generally resulting in lower transport rates.

The control of dust emissions by wind and mechanical disturbance (e.g., vehicle travel on unpaved roads) has relied heavily on increasing the binding energy for soils through the topical application of water or chemical stabilizers. The effectiveness of this type of control measure is highly variable. Chemical suppressant effectiveness degrades upon exposure to the environment and the accompanying physical and chemical weathering processes that reduce the binding energy among particles, allows the brittle failure rate of the protective layer to increase, and release particles from the matrix held together by the suppressant.

An alternative approach to controlling sand movement and dust emissions is to use knowledge of aerodynamics and sediment transport processes to design and engineer effective surface roughness configurations to control windblown sediment transport.

In particular implementations, the present disclosure provides engineered roughness elements. Engineered roughness elements are those which are either produced to include or are, specifically selected because they include, features that enhance the ability of the engineered roughness element, or an array of such elements, to reduce particle transport, or otherwise improve their functionality in such application. Such engineered features can include those which facilitate the placement, removal, or repositioning of elements; those which enhance the durability of the engineered roughness elements; those which enhance the performance of the engineered roughness elements, such as by extending the duration that elements can be used without having to reposition or otherwise interact with the elements or by enhancing the ability of the roughness elements to reduce particle transport; and those which selectively influence the flow pattern proximate the individual engineered roughness element or proximate, or through, an array that includes such engineered roughness elements. In some examples, engineered roughness elements do not include features, such as rocks or plants, that are naturally present in an area without artificial manipulation or augmentation.

According to a method of the present disclosure, engineered roughness elements are used to reduce the shear stress at the surface of a soil that is prone to windblown dust emission, which can directly impact the transport process, such as by physical interaction of the element(s) with the particles in motion. This approach relies on the fact that the movement of sand through the saltation process is largely responsible for large-scale dust emissions and that retarding the saltation process has a direct effect on reducing dust emissions. The disclosed approach works to stabilize a surface, partly by covering a portion of the surface and making it unavailable for interaction with wind, but mostly by extracting momentum from the wind and modulating the transport process through interaction of the particles in transport with the individual roughness elements, thus reducing sand transport and dust emissions.

Engineered roughness elements are typically selected to provide a desired degree of control over sand transport and dust generation. In at least some cases, desired dust control criteria can by met by various combinations of the number, type (including size, shape, and porosity), and distribution of engineered roughness elements. For example, a desired level of sand and dust control may be achieved by using either larger engineered roughness elements or using a larger number of smaller engineered roughness elements. In some cases, engineered roughness elements are used in conjunction with other types of roughness elements, such as naturally occurring roughness features (plants, rocks) or non-engineered roughness elements.

One significant physical parameter of the engineered roughness elements is their height. One effect of height is shear-stress reduction at the surface. However, engineered roughness element height can have additional effects on particle, such as dust and sand, movement. This effect can be increasingly pronounced when the engineered roughness height approaches the height of the sand saltation cloud. The engineered roughness element height needed for a particular level of sand and/or dust control typically depends on the environment in which the elements will be used. That is, harder surfaces typically result in sand particles travelling higher above the surface. Thus, higher engineered roughness elements may be indicated for harder surfaces. Although the height of engineered roughness elements can vary based on a number of factors associated with any particular implementation, engineered roughness elements can typically range from about 0.005 meters to about 100 meters, such as from about 0.05 meters to about 10 meters, from about 0.5 meters to about 2 meters, from about 0.5 meters to about 1 meter, from about 0.25 meters to about 1.5 meters, from about 0.25 meters to about 1 meters, from about 0.5 meters to about 1.5 meters, from about 0.25 meters to about 2 meters, or from about 1 meters to about 2 meters. All other factors remaining equivalent, softer surfaces can typically use smaller numbers within that range to achieve the same degree of sand and/or dust control that would require higher numbers within that range to achieve an equivalent level of control for a hard surface.

In some examples, other physical dimensions of engineered roughness elements, such as width, depth, diameter, etc. are within the ranges set forth above for the height. The general shape of the engineered roughness element can be expressed as a ratio of the other dimension (width, depth, diameters, etc.) to the height. In various examples, the ratio is between about 100:1 to about 1:1 (typically for shorter engineered roughness elements) or between about 1:1 to about 1:100 (typically for larger engineered roughness elements). So, overall, the ratio is typically between about 100:1 and about 1:100, such as between about 50:1 and about 1:50, between about 25:1 and about 1:25, between about 10:1 and 1:10, between about 5:1 and 1:5, or between about 2:1 and about 1:2. In a specific example, the ratio is about 1:1.

The engineered roughness elements may be made in a variety of shapes, including three-dimensional shapes having cross sections that are generally circular, semi circular, or polygonal. For examples, the cross section, in specific examples, is circular, semicircular, arcuate, triangular, square, quatrefoil, oval, cloverleaf, pie slice, star, rectangular, or trapezoidal. In some examples, the engineered roughness elements have a uniform, or generally uniform shape. In other examples, individual engineered roughness elements have complex, composite, or otherwise varying shapes and porosities. For example, an engineered roughness element may have differing shapes at different portions of the device, such as at the upper or lower or right and left sections. In a specific example, the engineered roughness element has the combined shape of a circle coupled to a rectangle. In one example, when placed, the rectangular portion rests on a surface and the circular portion is located at an upper end of the engineered roughness element.

An engineered roughness element having differing shapes can include an engineered roughness element having the same (or different) overall shape but with the dimension of a parameter (height, width, depth, diameter) etc., differing at different points on the engineered roughness element. For example, an engineered roughness element may have a width that tapers from a lower portion of the device to an upper portion of the device (or vice versa). In particular examples, the engineered roughness element includes a large base so that the normal and shearing stress presented by the engineered roughness element's weight at the surface is minimized. The large base helps ensure that the engineered roughness element does not sink into the soil as time passes after its installation. Specifically, the force per unit area at the base of the engineered roughness element due to gravity may be selected to be less than the soil elastic limit under both wet and dry conditions.

Engineered roughness elements may employ different shapes or dimensions in a single engineered roughness element in order to enhance various properties of the device, such as their ability to control sand/or dust (such as indicated by the coefficient of drag of the shape), their manufacturability, stability, durability, or ease of installation, adjustment, or removal. For example, an engineered roughness element may have a base that facilitates maintaining the engineered roughness element upright and an upper portion that maximizes sand/or dust control. In another example, the engineered roughness elements are manufactured with features, such as slots or apertures, that facilitate placement, adjustment, or removal, such as by being configured to accommodate a forklift.

The shape of the engineered roughness element can be isotropic so that the cross-section is identical both in the direction perpendicular to the prevailing wind and in the direction parallel to the prevailing wind. A sphere is an example of an isotropic shape because the cross section as viewed from any direction is a circle with diameter equal to that of the sphere. Optionally, the engineered roughness element may be anisotropic so that the cross section varies depending on the engineered roughness element's orientation. For example, a pill has a cross section of a circle if viewed from one orientation, but that of an oval if viewed from another orientation.

In other cases, the elements are designed with features that reduce shadows.

Engineered roughness elements may be made from a variety of materials and combinations of materials. In particular examples, engineered roughness elements are made from plastics, metals, composite materials, ceramics, cements, wood, or biomass (such as straw or hay bales). Materials may be chosen based on a variety of factors, including desired cost, ambient weather conditions, degree of dust reduction, topography, installation method, or installation duration. Different materials may affect the drag coefficient of the individual engineered roughness elements. In certain implementations, engineered roughness elements are constructed from one or more materials to impart to the roughness element a bulk density between that of water and the surrounding soil. Such a density can be helpful so that in the event of local flooding, the engineered roughness element does not float atop storm water and leave the location of original placement. In further implementations, the material is selected to be resistant to UV radiation and water degradation.

In particular examples, the engineered roughness elements are at least substantially non-erodible. In some cases, substantially non-erodible engineered roughness elements are those that can maintain an effective level of sand and/or dust control over an extended period of time, such as at least 1, 2, 3, 4, 5, 10, 20, or 30 years.

Even for a particular material, engineered roughness element may be constructed so as to maximize its coefficient of drag, such as by providing the engineered roughness element with a rougher surface rather than a smoother surface. In a multi-element deployment influencing where engineered roughness element wakes impinge upon the surface and interact with wakes created by adjacent engineered roughness elements can offer another means to influence the effectiveness of the ensemble of engineered roughness elements to affect sediment entrainment and transport.

The drag coefficient of the engineered roughness elements may also be affected by its porosity. In at least some cases, porous engineered roughness elements have higher drag coefficients than solid (non-porous) engineered roughness elements. Those of ordinary skill in the art will understand how to achieve an overall level of sand and/or dust control in a particular environment by balancing performance (desired level of particle control), environmental (surface topography, hardness, temperature, precipitation, particle size, particle distribution), and array and engineered roughness element parameters (including the number of roughness elements, their physical arrangement, their size, shape, material of construction, surface properties, porosity and other factors).

In addition to slowing down airflow, roughness element porosity also influences permeation of material through the roughness element. A engineered roughness element that is porous in the appropriate region can serve to not only extract momentum from the airflow through the usual fluid drag forces, but also to extract saltating sand grains from the sediment transport system. With reference to FIG. 1, the kinetic energy of moving sand typically exhibits a height profile above ground level (x axis) that is dictated by two parameters. The first is the distribution of sand with height above the surface and the second is the speed of travel of sand grains at that height. The former decreases with height above the surface while the latter increases with height. The kinetic energy within a layer of saltating sand with a height of $\Delta H$ is proportional to the density of sand grains in that layer and the square of the speed of sand grains in that layer.

Figure 2:
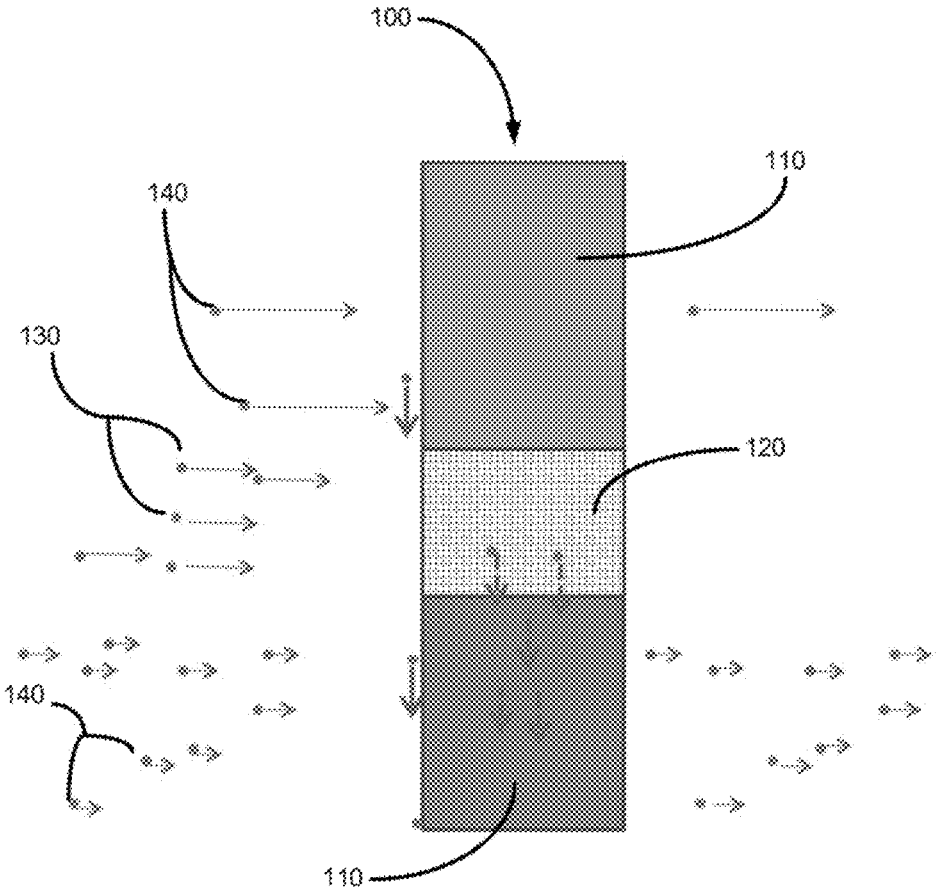
FIG. 2 is a schematic diagram illustrating how particles flow around porous and non-porous portions of an engineered roughness element.

As illustrated in FIG. 2, a porous engineered roughness element 100 has nonporous regions 110 and a porous region 120. The element 100 is designed to capture sand grains 130 at the height of maximal kinetic energy can enhance dust transport reduction efficiency as compared to a roughness element that relies on fluid flow modification alone. Sand grains 140 contacting the nonporous portions 110 of the element 100 may fall to the ground near or around element 100 or continue in suspension after encountering roughness element 100 but are not typically captured within the roughness element 100. The porous region 120 may be larger or smaller than shown in FIG. 2. In a particular example, the entire element 100 is porous, and the nonporous region is omitted.

Engineered roughness elements can exhibit porosities that range from zero for a non-porous element to as high as about 98%, about 99%, or about 100%, such as about 98%, about 99%, or about 100% by volume or by surface area. In some examples, the roughness element has a porosity of between about 5% and about 99%, such as between about 10% and about 75%, between about 15% and about 60%, between about 20% and about 50%, or between about 25% and about 40%. In further examples, the engineered roughness elements are about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, about 99%, or about 100% porous. In further examples, the engineered roughness elements are at least about 10%, at least about 20%, at least about 25%, at least about 30%, at least about 35%, at least about 40%, at least about 45%, at least about 50%, or at least about 60% porous.

Optionally, portions of a roughness element can be porous while other portions are not. Porosity can be achieved by any suitable means, such as by manufacturing the roughness element with pores, perforating a surface by means of holes, cutting out material from a roughness element, or by spacing surfaces in the along wind direction so that from the perspective of the wind, the roughness element is porous (but also completely opaque in the context of light transmission). The latter can be achieved, for example, by placing rectangles in a regular array with space between the rectangles in both the x and y directions. Another way of creating a porous engineered roughness element is to use fibers and meshes to fill void spaces within the cavity of an object.

The degree of porosity can also be used to affect fluid transport through and around the engineered roughness elements, with larger pore sizes or greater pore density typically allowing more facile movement through the engineered roughness element. In some examples, the amount of porous surface on an engineered roughness element is balanced against the degree of porosity (such as pore size or pore density) to provide a desired degree of modification of fluid flow. For example, the same level of fluid flow modification may be achieve by increasing the amount of porous surface while decreasing the pore density, or by increasing the pore density with a reduced amount of porous surface. In particular examples, the porosity of a region of an engineered roughness element is expressed as a percent permeability relative to a corresponding nonporous surface, with 100% representing complete permeability/unobstructed fluid flow through that region of the engineered roughness element. In some examples, the permeability is at least about 5%, at least about 10%, at least about 20%, at least about 25%, at least about 30%, at least about 35%, at least about 40%, at least about 45%, at least about 50%, at least about 55%, at least about 60%, at least about 65%, at least about 70%, at least about 75%, at least about 80%, at least about 85%, at least about 90%, or at least about 95%. In further examples, the permeability is about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, about 99%, or about 100%. In yet further examples, the permeability is between about 5% and about 100%, such as between about 10% and about 95%, between about 20% and about 90%, between about 25% and about 85%, or between about 30% and about 90%.

In at least certain embodiments, individual engineered roughness elements can be easily attached or adjoined in order to create larger roughness elements, such as elements having a larger height, width, or depth than individual constituent elements. In this way, a standard roughness element can be combined in various ways to maximize efficiency in differing operating environment or within different locations of a single operating environment. In one example, the roughness elements are stackable. In a specific example, the roughness elements are stackable plastic forms, such as buckets. The plastic forms may be weighted to enhance their stability.

Figure 3:
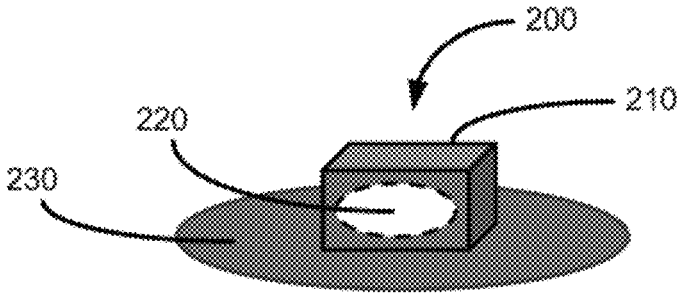
FIG. 3 is a schematic diagram illustrating an engineered roughness element according to an embodiment of the present disclosure.

FIG. 3 presents an example of a specific engineered roughness element 200 according to an embodiment of the present disclosure. The roughness element 200 is constructed of a concrete block 210. Inside the block, a plastic oval bladder 220 is filled with air. In some cases, the block is tethered to a surface. For example, the block 210 may be tethered to a thin, large, circular concrete base 230. The density of the block can be adjusted by increasing or decreasing the size of the plastic oval that is filled with air in order to cause the block to be buoyant when water is present. This can allow the block to reset itself once the water is removed, which can also increase its effectiveness as a dust and/or sand control element. In other examples, the engineered roughness element 200 has a shape other than a block and may employ bladders made from materials other than plastic. In addition, in these further examples the cavity and bladder are not required to have an oval shape.

In one embodiment, one or more of the engineered roughness elements are intended to remain fixed, or stationary, when placed in an array. In another embodiment, one or more roughness elements are intended to move. This movement, may, for example, help maximize dust and/or sand control or improve other operational parameters of the array. In one implementation, the engineered roughness elements are adaptable engineered roughness elements that move in response to artificially induced or environmental factors, such as wind speed or direction, in order to particle dust control. In another example, engineered roughness elements move in order to maintain their ability to control particles, such as shifting positions in the array to avoid particle buildup that could interfere with roughness element operation. Roughness elements can be active or passive.

Figure 4A:
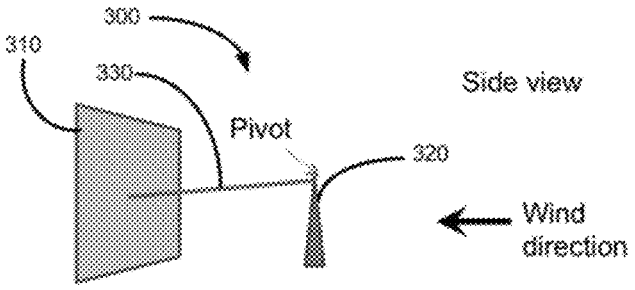
FIG. 4A is a schematic diagram illustrating a side view of an adaptive engineered roughness element according to an embodiment of the present disclosure.
Figure 4B:
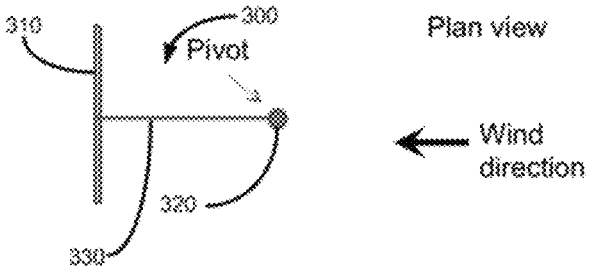
FIG. 4B is a schematic diagram illustrating a plan view of an adaptive engineered roughness element according to an embodiment of the present disclosure.
Figure 4A:
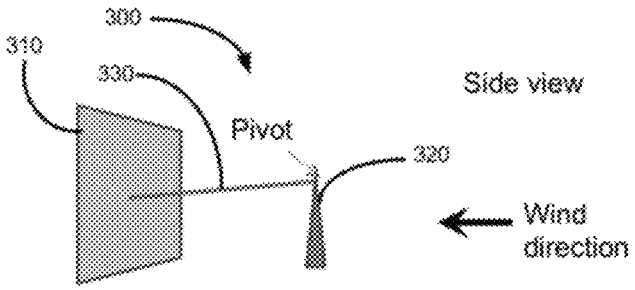
Figure 4B:
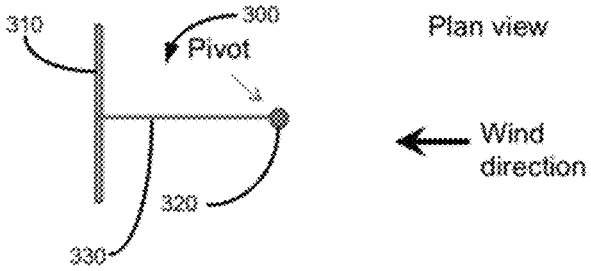

FIGS. 4A and 4B illustrate an example of a passive engineered roughness element 300 that improves particle control by moving in response to changes in wind direction. The roughness element 300 includes a particle control element 310 (such as a rectangular sheet) attached to a pivot 320 by an arm 330. In a specific implementation, the particle control element 310 rotates in a plane parallel to the ground to maintain the particle control element 310 perpendicular to the wind direction (that is, the inner surface of the dust control element 310 receives the force of the wind).

Figure 5A:
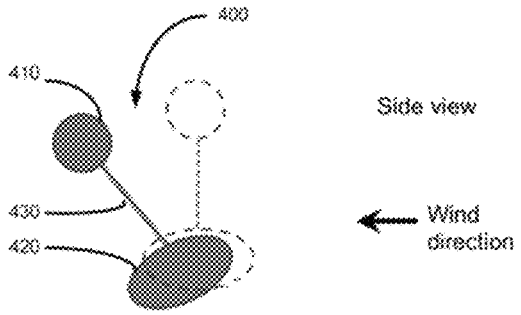
FIG. 5A is a schematic diagram illustrating a side view of an adaptive engineered roughness element according to an embodiment of the present disclosure.
Figure 5B:
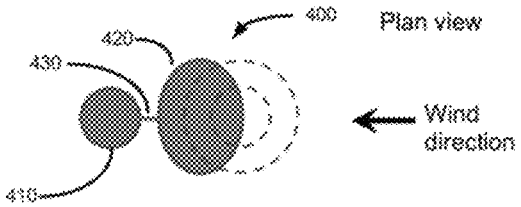
FIG. 5B is a schematic diagram illustrating a plan view of an adaptive engineered roughness element according to an embodiment of the present disclosure.

FIGS. 5A and 5B illustrate a passive movement engineered roughness element 400 that rotates in a plane (or planes) perpendicular to the ground. The engineered roughness element 400 includes an upper particle control element 410 coupled to a base 420 by an arm 430. When wind contacts the particle control element 400, the element 400 rotates in the direction of the wind. The base 420 of the roughness element 400 can be designed to facilitate such rotation (such as by having a curved base 420). Alternatively, the arm 430 can be coupled to a base 420 in a manner to allow movement, such as a tensioned ball joint.

Figure 6A:
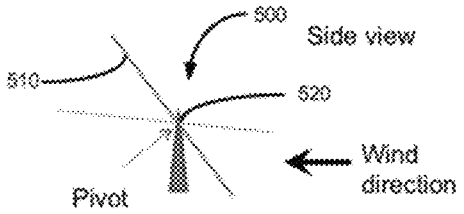
FIG. 6A is a schematic diagram illustrating a side view of an adaptive engineered roughness element according to an embodiment of the present disclosure.
Figure 6B:
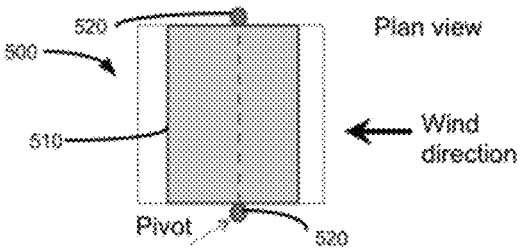
FIG. 6B is a schematic diagram illustrating a plan view of an adaptive engineered roughness element according to an embodiment of the present disclosure.

FIGS. 6A and 6B illustrate an engineered roughness element 500 with active movement. The roughness element 500 features a particle control element 510, such as rectangular sheet, pivotably coupled to one or more supports 520 having pivot points. The angle of the wind contacting the surface of the particle control element 510 relative to the surface (ground) can be varied in response to changes in wind direction. In addition, or alternatively, the particle control element 510 can be actively or passively rotated in response to changes in wind direction. In a particular example, an array of solar panels is employed as an array of surface roughness elements 500. In some cases, the position of the elements 510 is altered in order to track solar movement. However, the position of the elements 510 can be dictated in whole or part by sand and/or dust control considerations, rather than maximizing solar contact.

Figure 7A:
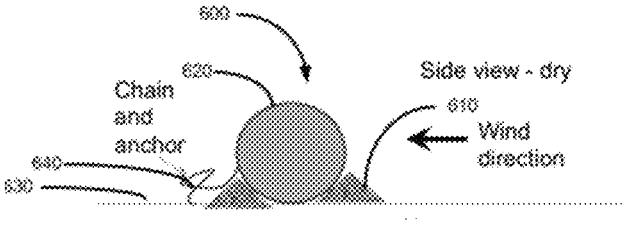
FIG. 7A is a schematic diagram illustrating a side view of an adaptive engineered roughness element according to an embodiment of the present disclosure under dry conditions.
Figure 7B:
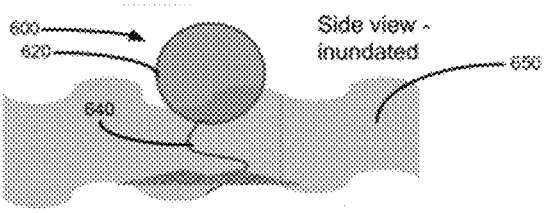
FIG. 7B is a schematic diagram illustrating a side view of an adaptive engineered roughness element according to an embodiment of the present disclosure under inundated conditions.
Figure 7C:
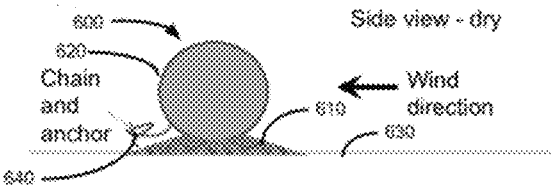
FIG. 7C is a schematic diagram illustrating a side view of an adaptive engineered roughness element according to an embodiment of the present disclosure under dry conditions after having been inundated.

The engineered roughness element 600 of FIGS. 7A-7C is a passive movement device that is adapted to reposition itself on top of accumulated particles 610. That is, as particles accumulate around a roughness element 600, the ability of the element to capture further particles may be reduced. The device of FIGS. 7A-7C includes a spherically shaped particle control element 620 coupled to an anchor 630 by a tether 640 (such as a wire, cable, rope, chain, line, etc.). The anchor may be, for example, a weighted object or an objected affixed to a surface, such as an eyebolt embedded in concrete or a stake driven into the ground. In a specific implementation, the particle control element 620 is buoyant. When the surface on which the element 620 rests accumulates water 650 (either because of intentional "flooding" or through natural precipitation or water flow), the particle control element 620 floats, freeing itself in whole or part from accumulated particles 610. When the water subsides, the particle control element 620 again rests on the surface. In yet another implementation, the roughness element 620 is shaped and constructed to as to cause the element 620 to move in response to particle buildup. For example, the device 620 may be curved, and appropriately weighted, to roll when particles build up predominately on one side (which could be common in areas where prevailing winds were typically from single direction).

As a variant to the roughness element of FIGS. 7A-7C, the engineered roughness element 600 can be designed for active movement, in addition to or in place of passive movement. The tether 640 prevents the particle control element 620 from travelling too far from its desired location. For example, the roughness element 600 can include an actuating device, such as a piston, to cause the device 610 to move in order to be positioned away from areas of particle build up. Such active repositioning may be carried out automatically, such as on a scheduled basis or in response to sensor input indicating that repositioning would be beneficial, or manually.

Roughness elements can be used in either linear patterns/rows of continuous elements or in matrix distributions in two dimensions. An example of the former is a series of roughness elements aligned perpendicularly to the direction of prevailing wind so that when viewed from above the roughness elements have the appearance of parallel rows. An example of the latter is the use of engineered roughness elements in a grid pattern. Deviations from regular patterns may be useful. For example, there may be advantages to combining rows of engineered roughness elements that are perpendicular to particle flow with sections of engineered roughness elements that are oblique to the flow or with individual engineered roughness elements in between rows. In another example, it may be beneficial to use a higher density of engineered roughness elements on the windward side of a large engineered roughness element installation and use less dense configurations in the middle portion of the installation. These intentional density changes enhance the ability of dense roughness elements to interrupt the shear stress of the wind and transport of sand into the regions of the array where a smaller density of engineered roughness elements is used. For individual engineered roughness elements, there may be value in staggering individual engineered roughness elements in a regular or irregular manner, or to mimic vegetation patterns, so as to maximally disrupt the air flow from a variety of possible wind directions.

In some embodiments, the engineered roughness elements are arranged to reduce particulate flux by at least about 50%, such as at least about 80%, such as at least about 90%, such as at least about 95%, such as at least 97%, such as at least 98%, such as least 99%. Most currently available dust control technologies provide efficiencies between 80% and 95%.

Figure 8:
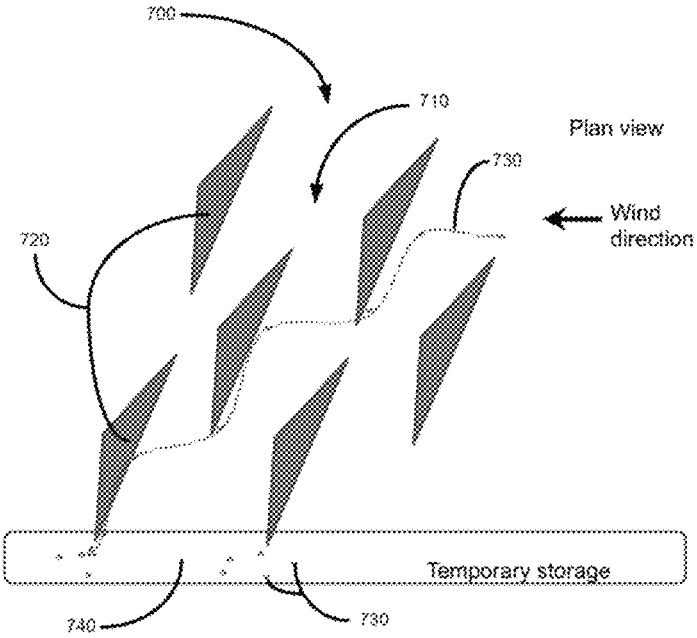
FIG. 8 is a schematic diagram illustrating how an array of roughness elements can be used to channel particles into a particular location.
Figure 7:
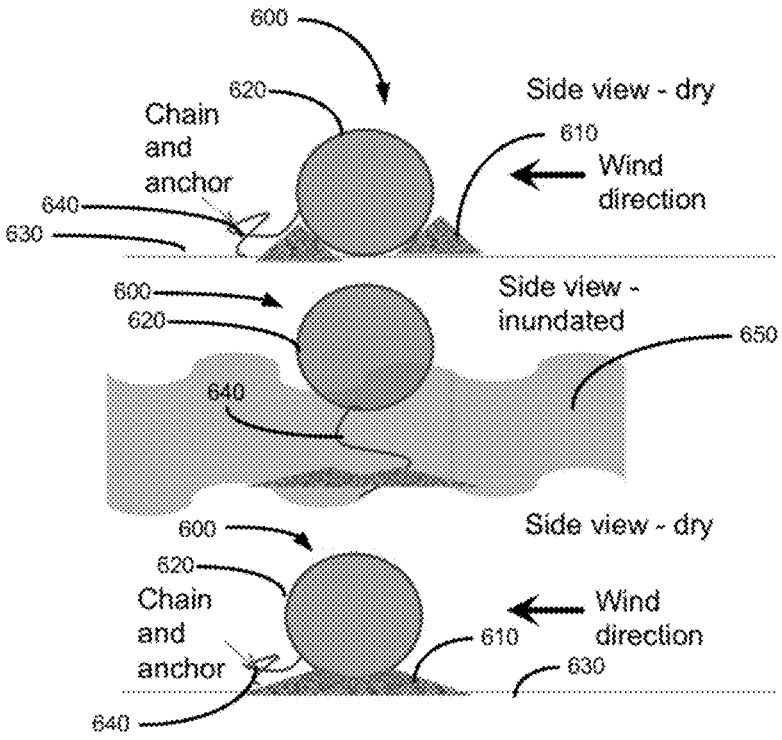
Figure 8:
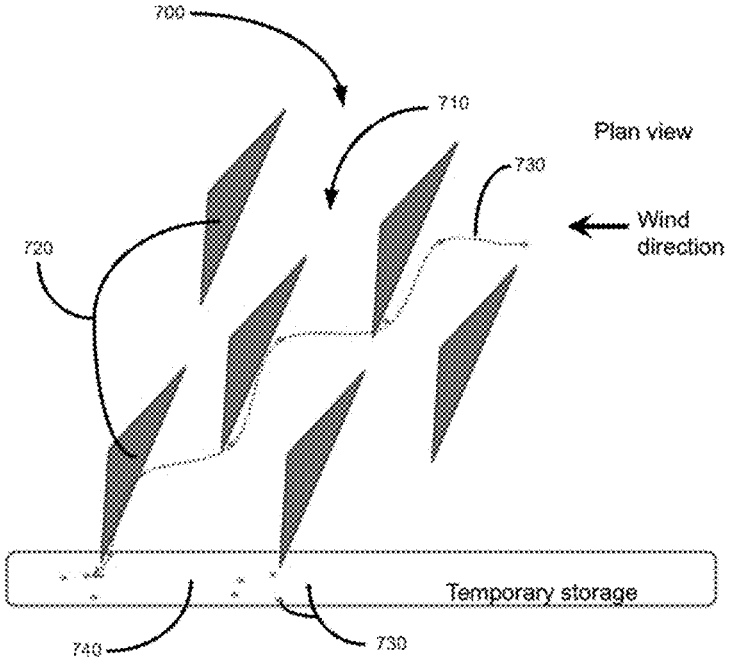

As shown in FIG. 8, in at least some implementations, such as implementation 700, an array of engineered roughness elements 710, including the design of individual engineered roughness elements 720, is designed to channel or funnel particles 730 into a particular location 740. Funneling particles 730 into a particular location 740 may be beneficial for a number of reasons, such as increasing the operating efficiency of the array 710, overall, maintaining open areas within the area or in areas serviced by the array 710 (such as maintaining viable roadways), or to facilitate removal of accumulated particles 730. In a particular example, the array 710 funnels particles 730 into a channel 740. At various intervals, the particles 730 can be removed from the channel 740, such as using mechanical action (such as a bulldozer) or altering environmental conditions (such as sending water through the channel 740).

In a specific example, individual array elements are positioned so as to create flow paths that funnel particles into a particular location. In another example, at least a portion of the individual array elements are constructed so as to channel particles in a particular direction. For example, they may be shaped to cause anisotropic particle flow about the engineered roughness element. The engineered roughness elements may be moveable (either actively or passively), to assist in consistently directing particle movement to a desired location under variable wind conditions.

Figure 9:
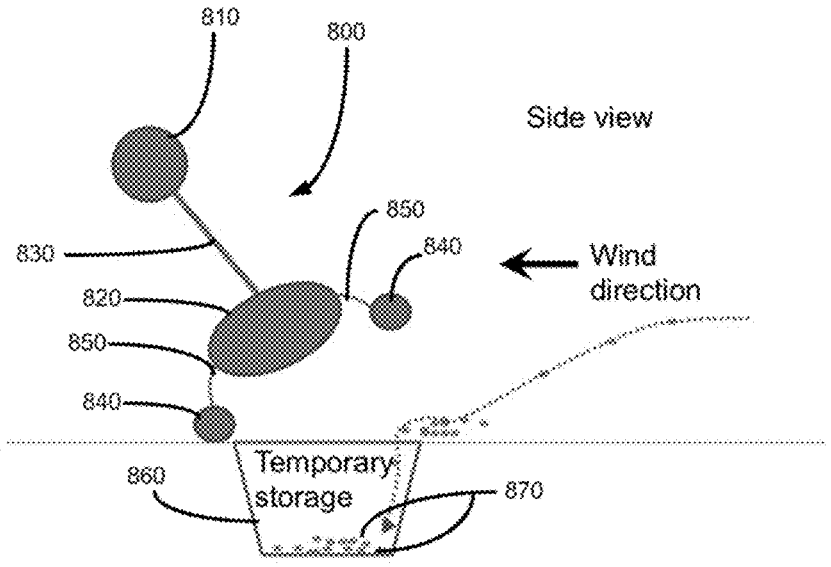
FIG. 9 is a schematic diagram illustrating an adaptive engineered roughness element according to an embodiment of the present disclosure.

In another implementation individual engineered roughness elements both channel particles into a particular location and control access to the location. As shown in FIG. 9, an engineered roughness element 800 includes an upper particle control element 810 coupled to a base 820 by an arm 830. The base 820 is coupled to one or more supports 840 by leg(s) 850. The engineered roughness element 800 passively moves in respond to changes in wind direction (or wind speed). For example, wind hitting the particle dust control element 810 may cause the engineered roughness element 800 to rock to the side, such as temporarily being supported by one or more supports 840. As the engineered roughness element 800 moves, it allows access to a particle storage area 860, such as a pit formed proximate the engineered roughness element 800 (such as being covered by the base 840 when resting on a sufficient number of supports 840). Under sufficient wind conditions, the engineered roughness element 800 moves, enables access to the pit 860, directs particles 870 into the pit 860, and disables access to the pit 860 when wind conditions are no longer sufficient. In a specific example, the pit 860 is emptied as desired, such as by mechanical action or flooding. In another example, the engineered roughness elements 800 are repositioned when the pit 860 becomes full, or the engineered roughness elements 800 are otherwise no longer operating as desired. Although described with respect to a passively moving engineered roughness element, this embodiment could be carried out using roughness elements with active movement.

Figure 10:
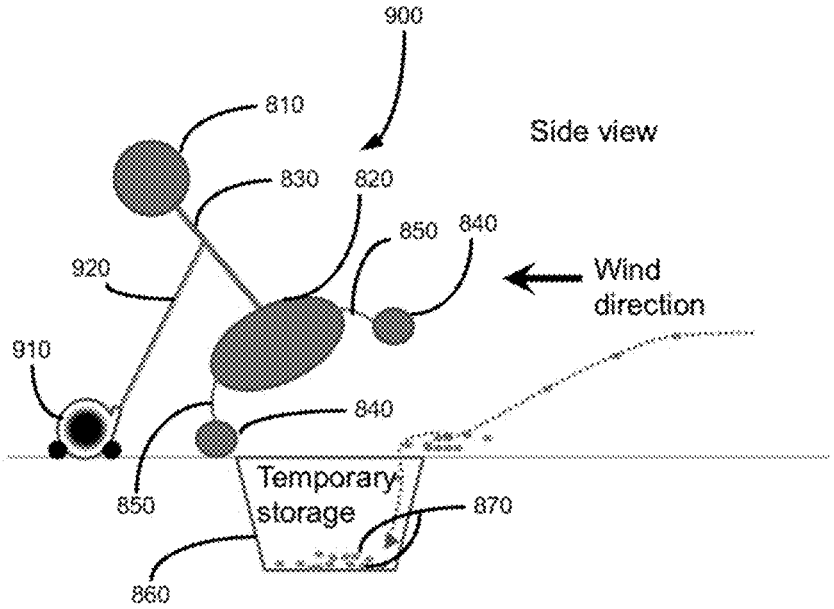
FIG. 10 is a schematic diagram illustrating an adaptive engineered roughness element according to an embodiment of the present disclosure.

FIG. 10 illustrates an engineered roughness element 900. The engineered roughness element 900 is generally similar to engineered roughness element 800 of FIG. 9, and corresponding parts are correspondingly labeled. Engineered roughness element 900 further includes an electrical motor or engine 910 that is coupled to the engineered roughness element 900. In some examples, the motor 910 is coupled to the engineered roughness element 900 by a connector 920, such as a chain, line, band, string, rope, or similar connector. The motor 910 and connector 920 can be used to effect the motion required to achieve dust and/or sand control and channeling of particles. In some implementations, the motor 910 is affixed to a surface and used to actively manipulate the engineered roughness element 900 so that during some periods particles 870 are channeled into a capture pit 860, whereas during other times, the capture pit 860 is covered.

Figure 11:
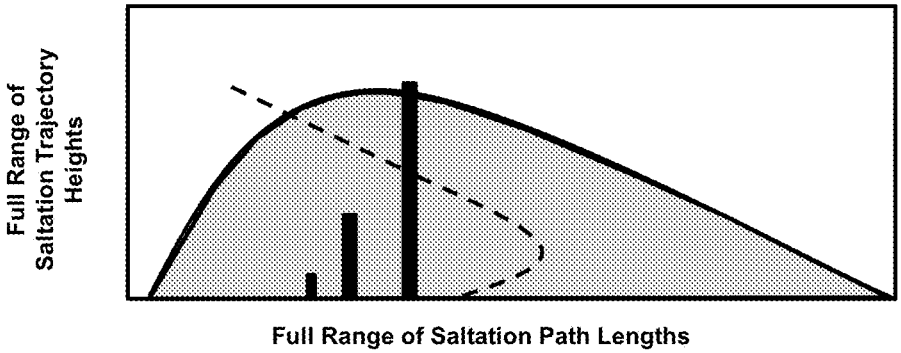
FIG. 11 is graph of saltation trajectory height versus saltation path length.

An empirical relationship was determined between $\lambda$ and reduction in sand flux, expressed as sand flux normalized to upwind flux (NSF). The roughness element height, in addition to its effect on shear stress partitioning by impacting $\lambda$ in Equation 2, has a secondary and important means for influencing the sand transport process. The impact of the roughness element height is another parameter in influencing in the hindrance of sand grain kinetic energy propagation through the saltation process (FIG. 11). Sand transport efficiency for a large patch of roughness typically scales both proportionally with $\lambda$, decreases at a greater rate as a function of downwind distance with increasing $\lambda$, and as a function of increased roughness element height. These factors can be used to help develop engineered roughness for controlling sand movement and the accompanying dust emissions.

In some aspects of the disclosure, engineered aerodynamic roughness elements are sized and arranged in a manner that largely allows unobstructed access to the land surface. In another embodiment, the elements are designed for reduced maintenance or to require no maintenance. The first roughness configuration would be to create a $\lambda$ of 0.03, using 916 elements, such as plastic forms (buckets, in a particular example), in a staggered array spaced 1.7 m apart with 1.7 m between rows in an area 50 m by 50 m. The amount of expected sand flux reduction can be estimated with the relationship:

$$NSF=0.0004\lambda^{-1.871} \quad (3)$$

where NSF is the normalized sand flux, which is the ratio of sand flux in the presence of the roughness divided by sand flux in the absence of roughness. The NSF value at the trailing edge of the roughness for $\lambda=0.03$ is estimated to be 0.3. The roughness array could be reconfigured so that $\lambda$ is unchanged, but the effective height of the individual roughness elements is increased. In practice, this is accomplished efficiently by placing every other roughness element on top of the roughness element immediately adjacent to it. This should not affect the control of particle movement due to the shear stress being modulated by the roughness element, but an additional increase in reducing the sand transport effectiveness (27%) is expected due to the increased height of the roughness element.

The reconfiguration of elements can be repeated several times to obtain a range of roughness element heights for a constant value of $\lambda$.

In further embodiments, the elements are arranged such that $\lambda$ is less than or equal to about 0.03. In yet further embodiments, the minimum inter-roughness spacing is about 5 meters. An inter-element spacing of 5 meters is desired as this is a minimum distance that allows for medium duty vehicle activity.

It is to be understood that the above discussion provides a detailed description of various embodiments. The above descriptions will enable those skilled in the art to make many departures from the particular examples described above to provide apparatuses constructed in accordance with the present disclosure. The embodiments are illustrative, and not intended to limit the scope of the present disclosure. For example, although specific embodiments are illustrated in FIGS. 2-10, other embodiments may combine features of these embodiments and may include variations as disclosed herein and as within the skill of those of ordinary skill in the art. For example, unless clearly specified otherwise, the present disclosure embraces embodiments that include engineered roughness elements having different shapes, sizes, or construction (such as porosity or material of construction) than specifically described with reference to, or as shown in, the figures. The scope of the present disclosure is rather to be determined by the scope of the claims as issued and equivalents thereto.

What is claimed is:

1. A method of reducing airborne particles in an area, comprising placing a plurality of engineered roughness elements in or proximate the area in an array, the plurality of engineered roughness elements being spaced apart from one another by at least about 1.7 meters, at least a portion of each of the engineered roughness elements having a height of between about 0.05 meters and about 10 meters, at least a portion of each of the engineered roughness elements having a width of between about 0.05 meters and about 10 meters, at least a portion of each of the engineered roughness elements having a depth of between about 0.05 meters and about 10 meters, each of the engineered roughness elements comprising an upper dust control element coupled to a buse by an arm, the base comprising a bottom portion curved to allow the engineered roughness elements to tilt when the upper dust control element is contacted by wind having a sufficient velocity, and the array configured to provide a reduction in airborne particles of at least about 50% by reducing sand movement in, or proximate to, the array.

2. The method of claim 1, wherein each of the engineered roughness elements comprises a porous section at a first height of the engineered roughness element and a non-porous section at a second height of the engineered roughness element.

3. The method of claim 2, wherein the porous section is located substantially at a height where airborne particles interacting with the engineered roughness elements have a maximum kinetic energy.

4. The method of claim 1, wherein the engineered roughness elements are configured to move when particles accumulated proximate the engineered roughness elements exceed a threshold.

5. The method of claim 1, wherein the engineered roughness elements have a height of between about 0.5 meters and about 2 meters.

6. The method of claim 1, wherein the engineered roughness elements are spaced apart from one another by at least about 5 meters.

7. A method of reducing airborne particles in an area, comprising placing a plurality of engineered roughness elements in or proximate the area in an array, at least a portion of each of the plurality of engineered roughness elements having a height of between about 0.05 meters and about 10 meters, at least a portion of each of the plurality of engineered roughness elements having a width of between about 0.05 meters and about 10 meters, at least a portion of each of the plurality of engineered roughness elements having a depth of between about 0.05 meters and about 10 meters, the engineered roughness elements being spaced apart from one another by at least about 1.7 meters, the array having a roughness density, $\lambda$, of about 0.03 or less, and the array configured to provide a reduction in airborne particles of at least about 50% by reducing sand movement in, or proximate to, the array.

8. The method of claim 7, wherein the engineered roughness elements comprise apertures for receiving the blades of a forklift.

9. The method of claim 7, wherein the engineered roughness elements comprise a dust control element coupled to a pivot by an arm.

10. The method of claim 7, wherein each of the engineered roughness elements comprises an upper dust control element coupled to a base by an arm, the base comprising a bottom portion curved to allow the engineered roughness elements to tilt when the upper dust control element is contacted by wind having a sufficient velocity.

11. The method of claim 7, wherein the engineered roughness elements comprise a dust control element pivotably coupled to a support, the dust control element being rotatable about an axis parallel to the ground.

12. The method of claim 7, wherein the engineered roughness elements comprise a buoyant dust control element coupled to an anchor by a tether.

13. The method of claim 7, wherein the individual engineered roughness elements of the array are positioned to cause particles moving through an area to be channeled to a storage location.

14. The method of claim 7, wherein at least a portion of each of the engineered roughness elements has a triangular, circular, semicircular, trapezoidal, rectangular, or square cross-section.

15. The method of claim 7, wherein the engineered roughness elements are spaced apart from one another by at least about 5 meters.

16. The method of claim 7, wherein the engineered roughness elements have a height of between about 0.5 meters and about 2 meters.

17. The method of claim 7, wherein each of the engineered roughness elements comprises a porous section at a first height of the engineered roughness element and a non-porous section at a second height of the engineered roughness element.

18. The method of claim 17, wherein the porous section is located substantially at a height where airborne particles interacting with the engineered roughness elements have a maximum kinetic energy.

19. The method of claim 7, wherein the engineered roughness elements are configured to move when particles accumulated proximate the engineered roughness elements exceed a threshold.

20. A method of reducing airborne particles in an area, comprising placing a plurality of engineered roughness elements in or proximate the area in an array, the plurality of engineered roughness elements being spaced apart from one another by at least about 1.7 meters, at least a portion of each of the engineered roughness elements having a height of between about 0.05 meters and about 10 meters, at least a portion of each of the engineered roughness elements having a width of between about 0.05 meters and about 10 meters, at least a portion of each of the engineered roughness elements having a depth of between about 0.05 meters and about 10 meters, each of the engineered roughness elements comprising an air filled bladder disposed within a concrete block, and the array configured to provide a reduction in airborne particles of at least about 50% by reducing sand movement in, or proximate to, the array.

* * * * *